United States Patent [19]

Choy et al.

[11] Patent Number: 4,804,491

[45] Date of Patent: Feb. 14, 1989

[54] AQUEOUS BASED ACIDIC HARD SURFACE CLEANER

[75] Inventors: Clement K. Choy, Walnut Creek, Calif.; Ellen E. Valachovic, Greenwood Lake, N.Y.

[73] Assignee: The Clorox Company, Oakland, Calif.

[21] Appl. No.: 926,448

[22] Filed: Nov. 3, 1986

[51] Int. Cl.[4] ..... C11D 3/39

[52] U.S. Cl. ..... 252/94; 252/95; 252/100; 252/142; 252/145; 252/186.27; 252/186.43; 252/188.2

[58] Field of Search ..... 252/95, 100, DIG. 14, 252/145, 186.27, 186.43, 94, 142, 188.2

[56] References Cited

U.S. PATENT DOCUMENTS

| | | | |
|---|---|---|---|
| 3,415,753 | 12/1968 | Stein et al. | 252/121 |
| 3,682,702 | 8/1972 | Hnizda | 134/41 |
| 3,732,170 | 5/1973 | Demangeon | 252/95 |
| 3,968,048 | 7/1976 | Bolan | 252/157 |
| 3,969,282 | 7/1976 | Kappler et al. | 252/559 |
| 3,985,668 | 10/1976 | Hartman | 252/99 |
| 3,997,460 | 12/1976 | Sirine et al. | 252/106 |
| 4,028,263 | 6/1977 | Gray | 252/99 |
| 4,051,056 | 9/1977 | Hartman | 252/99 |
| 4,123,376 | 10/1978 | Gray | 252/99 |
| 4,146,496 | 3/1979 | Gray | 252/99 |
| 4,169,076 | 9/1979 | Kawakami et al. | 252/558 |
| 4,244,840 | 1/1981 | Straw | 252/540 |
| 4,362,639 | 12/1982 | Eoga | 252/99 |
| 4,599,186 | 7/1986 | Choy et al. | 252/102 |
| 4,666,622 | 5/1987 | Martin et al. | 252/99 |

FOREIGN PATENT DOCUMENTS

| | | |
|---|---|---|
| 0183894 | 6/1986 | European Pat. Off. . |
| 0199385 | 10/1986 | European Pat. Off. . |
| 917432 | 2/1963 | United Kingdom . |
| 1269677 | 4/1972 | United Kingdom . |
| 2073233A | 3/1981 | United Kingdom . |
| 2073233 | 10/1981 | United Kingdom . |

OTHER PUBLICATIONS

"Oxone Monopersulfate Compound", DuPont Data Sheet (5 pages, Undated).

*Primary Examiner*—John F. Niebling
*Assistant Examiner*—Isabelle Rodriquez
*Attorney, Agent, or Firm*—Majestic, Parsons, Siebert & Hsue

[57] ABSTRACT

Phase, stable, hard surface cleaners are provided comprising an acidic aqueous phase in which a linear alkyl aryl sulfonic acid and an alkali metal peroxymonosulfate are dissolved. The former component can provide improved chemical stability of the solubilized peroxymonosulfate, and the two components, when present in sufficient amounts, result in a flowable, plastic liquid which is capable of stably suspending abrasives.

3 Claims, No Drawings

AQUEOUS BASED ACIDIC HARD SURFACE CLEANER

FIELD OF THE INVENTION

The present invention relates generally to aqueous based hard surface cleaners, and more particularly to physically stable, acidic cleaners having solubilized linear alkyl aryl sulfonic acid and alkali metal peroxymonosulfate forming a stable aqueous phase.

BACKGROUND OF THE INVENTION

Both aqueous based and dry hard surface cleaners are known and useful for all purpose household cleaning, and often incorporate or provide a source of hypochlorite as an oxidizing agent because of its powerful bleaching and germicidal properties.

Clay-thickened, aqueous hard surface scouring compositions with hypochlorite are disclosed in U.S. Pat. No. 3,985,668, issued Oct. 12, 1976, to Hartman and in U.S. Pat. No. 4,051,055, issued Sept. 27, 1977, to Trinh et al. Such hypochlorite containing aqueous hard surface cleaners may include an abrasive, as disclosed by U.S. Pat. No. 4,051,056, issued Sept. 27, 1977, to Hartman, where inorganic colloid-forming clays are utilized as suspending agents for the expanded perlite abrasive material.

An aqueous solution of sodium hypochlorite is inherently basic as it is the salt of a weak acid (hypochlorous acid) and a strong base (sodium hydroxide). As is well known, hypochlorite ion is stabilized by basic solutions, and thus hard surface cleaners containing hypochlorite as oxidizing agent typically have a pH of greater than about 8.

Peroxymonosulfate is known to be an oxidizing agent, but its use in scouring cleansers has typically been in dry form with a halide salt. For example, U.S. Pat. No. 3,458,446, issued July 29, 1969, to Diaz discloses a dry scouring cleanser whose solid constituents include potassium monopersulfate and a bromide salt. As is well known, potassium monopersulfate and either a chloride or a bromide salt react in the presence of water to form hypochorite or hypobromite respectively. Dry compositions where bromide is oxidized by peroxymonosulfate to form hypobromite following dissolution in aqueous solution are also disclosed in U.S. Pat. No. 4,028,263, inventor Gray, issued June 7, 1977.

These prior known, dry compositions including peroxymonosulfate and a water-soluble halide salt to provide a source of hypohalite have typically had an alkaline pH when dissolved in water. Dry scouring compositions are awkward to use on vertical surfaces and on curved surfaces, such as plumbing, for removal of rust and mineral stains.

SUMMARY OF THE INVENTION

It is an object of the present invention to provide an aqueous based, acidic hard surface cleaner useful for all purpose, household cleaning such as removing rust, mineral and mildew stains.

It is another object of the present invention that the aqueous based, acidic hard surface cleaner includes peroxymonosulfate as a source of active oxygen.

It is yet another object of the present invention to provide a liquid hard surface cleaner which is flowable and in which abrasive particles may be stably suspended.

These and other objects are provided by a hard surface cleaner in accordance with the invention comprising a water base in which linear alkyl aryl sulfonic acid and an alkali metal peroxymonosulfate are dissolved and which form a phase-stable, acidic aqueous phase.

A first preferred embodiment of the invention is where the linear alkyl aryl sulfonic acid is in an amount not greater than about 10 wt. %, preferably from about 2 wt. % to 5 wt. %, and is in a weight ratio with respect to potassium peroxymonosulfate of from about 1:0.05 to about 0.05:1, more preferably about 1:0.1 to about 0.1:1. The potassium peroxymonosulfate is a source of active oxygen, and in this first embodiment, a single-phase, clear and isotropic aqueous solution is provided in which the chemical stability of solubilized peroxymonosulfate is improved by the presence of linear alkyl aryl sulfonic acid.

A second preferred embodiment of the invention is where at least about 5 wt. % linear alkyl aryl sulfonic acid and at least about 2 wt. % potassium peroxymonosulfate are present in solubilized form to provide a flowable, plastic liquid which is capable of stably suspending abrasive particles in amounts of up to about 50 wt. %. As with the first preferred embodiment, the potassium peroxymonosulfate is a source of active oxygen. In the second preferred embodiment, the potassium peroxymonosulfate also cooperates with the linear alkyl aryl sulfonic acid in providing non-Newtonian rheology.

A particularly preferred composition in accordance with the second embodiment includes a non-Newtonian aqueous phase having water, linear alkyl aryl sulfonic acid dissolved in the water in an amount from about 5 wt. % to about 20 wt. %, and potassium peroxymonosulfate dissolved in the water in an amount from about 2 wt. % to about 9 wt. %. Acid-stable abrasive particles, preferably in an amount from about 1 wt. % to about 30 wt. %, may be stably suspended in the aqueous phase due to the surprising cooperation of linear alkyl aryl sulfonic acid and potassium peroxymonosulfate in providing non-Newtonian rheology for the aqueous phase.

PREFERRED EMBODIMENTS OF THE INVENTION

The present invention provides phase-stable, hard surface cleaners comprising an acidic aqueous phase having two essential components dissolved therein which are useful for all-purpose household cleaning of hard surfaces. The two components are a linear alkyl aryl sulfonic acid and an alkali metal peroxymonosulfate.

The linear alkyl aryl sulfonic acid component of the present invention has the structure illustrated by Structure I:

STRUCTURE I

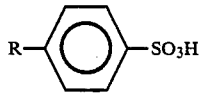

where R may be a linear alkyl averaging about 5 to 20 carbon atoms, more preferably is from about 7 to 14 carbon atoms, and most preferably is from about 10 to 12 carbon atoms.

Conveniently available linear alkyl aryl sulfonic acid has an average side chain of about 11.5 carbon atoms, will sometimes be referred to as linear dodecylbenzene sulfonic acid, and is sold by a number of suppliers (e.g. Witco Chemical Corporation as Witco 1298 Soft Acid, Pilot Chemical Company as Calsoft LAS-99, and Stepan Chemical Company as Bio Soft S-100).

Linear alkyl benzene sulfonic acid (hereinafter sometimes referred to as "HLAS" and exemplified in this application by linear dodecylbenzene sulfonic acid) is produced by a synthesis in which benzene is first alkylated with alkyl chloride in the presence of catalyst, and the alkylated benzene is next reacted with a sulfonating agent. The resultant linear alkyl benzene sulfonic acid is frequently then neutralized with an alkali metal hydroxide to produce the sulfonate, such as neutralization with NaOH to yield sodium alkyl benzene sulfonate (commonly called "LAS"). However, and as more fully discussed hereinafter, it is important that pH of the inventive compositions be within a relatively narrow, acid range and the linear alkyl aryl sulfonic acid component is most preferably in its acid form, rather than having been neutralized to a sulfonate.

It has been discovered that linear alkyl benzene sulfonic acids can, themselves, be utilized as hard surface cleaners, as disclosed in U.S. patent application Ser. No. 512,100, filed July 7, 1983, inventor Choy, of common assignment herewith, the disclosure of which is incorporated herein by reference. Thus, U.S. patent application Ser. No. 512,100 discloses that an improved, hard surface acid cleaner comprising an alkyl aryl sulfonic acid, at least 50 wt. % water, and having a pH of no more than about 6.5, provides effective and fast cleaning results on soap scums, hard water stains and greasy/oily stains. The alkyl aryl sulfonic acid component of application Ser. No. 512,100 preferably is a linear alkyl benzene sulfonic acid surfactant of the general structure illustrated by Structure I above, wherein R is an alkyl averaging 5 to 20 carbons, and is preferably present in an amount of about 0.001 to 50 wt. % of the cleaner.

The linear alkyl aryl sulfonic acid component of the present invention also provides effective cleaning of stains and soap scum, and in addition, has been discovered to have several surprising, advantageous properties when present in certain compositions including an alkali metal peroxymonosulfate, as further discussed hereinafter.

The inventive phase-stable hard surface cleaner must include an alkali metal peroxymonosulfate, which provides a source of active oxygen for the cleaner and which is dissolved in the aqueous phase. Suitable alkali metal peroxymonosulfates are potassium, lithium or sodium peroxymonosulfate.

Potassium peroxymonosulfate ($KHSO_5$) is available as a mixed salt ($2KHSO_5.KHSO_4.K_2SO_4$) from E. I. DuPont DeNemours and Company, Inc. under the trademark "Oxone". (Thus, 42.8 wt. % of the Oxone product is $KHSO_5$). The Oxone product is a white granular, free-flowing solid and has a practical solubility of about 20 wt. % (0.88% available oxygen), although solutions with higher levels than 20 wt. % may be made by means such as filtering a slurry of the triple salt. Filtration of a concentrated slurry of the Oxone product and then dilution of the filtrate is a preferred method of preparing compositions of the invention with greater than about 20 wt. % Oxone product.

For convenience and unless otherwise indicated, the triple salt, Oxone product will be utilized to exemplify the invention.

Compositions of the invention preferably have a pH of less than about 2, more preferably from about 1 to about 1.5. It has been discovered that inventive compositions having a pH of about 1 appear to be best for chemical stability of the peroxymonosulfate.

A small amount of an appropriate acidic agent, such as sulfuric acid, may be incorporated in compositions of the invention to reduce pH to about 1. If the less preferred alkyl benzene sulfonate salt is utilized instead of HLAS, then an acidic component will typically be used to adjust the pH to about 0.5 to about 2, more preferably about 1, and solubility of the peroxymonosulfate (as well as the surfactant) may tend to be reduced and thus lower the amounts which can be incorporated into solution. However, large amounts of an acidic component (and a pH of less than about 0.5 or greater than about 2) should be avoided in compositions of the invention, as illustrated by Example I, below.

EXAMPLE I

Compositions with 5 wt. %, 10 wt. %, and 20 wt. % Oxone product dissolved in water were prepared and the pH of each adjusted with sulfuric acid to 0.5, 1.0, and 2.0, respectively. The compositions were then subjected to accelerated aging and the active oxygen remaining as a percentage of initially present active oxygen determined. The data from this accelerated aging is presented in Table I, below.

TABLE I

| Composition (wt. % Oxone Product) | | pH | % Active Oxygen Remaining 16 Days at 120° F. | 32 Days at 120° F. |
|---|---|---|---|---|
| 1840-92-1 | 5 | 0.5 | 27.7 | 9.4 |
| 1840-92-2 | 10 | 0.5 | 50.0 | 27.1 |
| 1840-92-3 | 20 | 0.5 | 54.9 | 32.3 |
| 1840-92-5 | 5 | 1.0 | 53.8 | 42.5 |
| 1840-92-6 | 10 | 1.0 | 53.2 | 40.1 |
| 1840-92-7 | 20 | 1.0 | 50.2 | 35.4 |
| 1840-92-13 | 5 | 2.0 | 3 | — |
| 1840-92-14 | 10 | 2.0 | 3 | — |
| 1840-92-15 | 20 | 2.0 | 18.6 | 1.3 |

The use of large amounts of an optional acidic component, such as, for example, sodium bisulfate, is also undesirable in tending to cause phase separations and/or precipitation of the HLAS, as illustrated by Example II, below.

EXAMPLE II

Three aqueous compositions were prepared. The first aqueous composition had 16 wt. % $NaHSO_4$, 16 wt. % Oxone and 8 wt. % HLAS, the second aqueous composition had 8 wt. % $NaHSO_4$, 8 wt. % Oxone and 4 wt. % HLAS, and the third aqueous composition had 4 wt. % $NaHSO_4$, 4 wt. % Oxone and 2 wt. % HLAS. None of the three was a clear, single phase composition: the first had a upper foam phase and a cloudy lower liquid phase; the second was similar to the first; and, the third had an upper milky liquid and a white precipitate at the bottom.

The importance of utilizing the linear alkyl aryl sulfonic acid component in its acid form, rather than as a sulfonate, is illustrated by the unacceptably high pH values of the sulfonates. For example, a 20 wt. % solution of the sodium salt ("NaLAS", or sodium dodecyl benzene sulfonate) has a pH of 9.2, and a solution having 20 wt. % NaLAS and 5 wt. % Oxone product has a pH of 2.35. It is also believed that increased ionic strength generally tends to enhance the decomposition of peroxymonosulfate.

Table II, below, illustrates the relationship between the weight percent of the Oxone product dissolved in deionized water and active oxygen (where active oxygen was analyzed by iodometric thiosulfate titration and the solutions were at about 22° C.).

TABLE II

| wt. % Oxone Product | % a.o. |
|---|---|
| 3 | 0.1 |
| 5 | 0.2 |
| 10 | 0.4 |
| 20 | 0.9 |
| 30 | 1.4 |
| 40 | 1.7 |
| 50 | 2.5 |
| 60 | 2.7 |

Solutions of peroxymonosulfate become increasingly unstable at temperatures above about 21° C. A solution of the Oxone product, for example, at 2.5 wt. % or at 5.0 wt. % will have lost about 50% of active oxygen after 30 days storage at about 38° C., and will have substantially no oxygen remaining after thirty days storage at about 49° C.

The first embodiment of the present invention provides that the chemical stability (that is, the amount of active oxygen remaining over time) of solubilized peroxymonosulfate is improved by the presence of linear alkyl aryl sulfonic acid when the linear alkyl aryl sulfonic acid is in an amount not greater than about 10 wt. %, more preferably from about 2 wt. % to 5 wt. %, and is in a weight ratio with respect to an alkali metal peroxymonosulfate of from about 1:0.05 to about 0.05:1. A particularly preferred weight ratio is from about 1:1 to 1:0.5 of HLAS to Oxone product.

This improved chemical stability is illustrated by the data of Table III, below, where the comparison and inventive compositions were each maintained at about 38° C. (100° F.).

TABLE III

| Elapsed Days | % a.o. Remaining, Comparison Composition* | % a.o. Remaining, Inventive Composition** |
|---|---|---|
| 4 | 91 | 98 |
| 11 | 87 | 94 |
| 18 | 84 | 91 |
| 25 | 72 | 86 |
| 33 | 66 | 76 |
| 39 | 62 | 72 |
| 47 | 56 | 64 |

*5 wt. % Oxone product, rest water
**5 wt. % Oxone product, 5 wt. % HLAS, rest water Dye, fragrance and hydrotropes, so long as stable in the presence of the necessary peroxymonosulfate and HLAS components, may be incorporated into first embodiment compositions of the invention. Suitable hydrotropes, for example, include alkylated diphenyloxide disulfonates which are believed useful as cosurfactants and which may reduce electrolyte sensitivity of the HLAS component, as illustrated by Example III, below.

EXAMPLE III

An inventive composition was prepared having 5 wt. % Oxone product, 1 wt. % HLAS, and 0.5 wt. % mono- and di-decyl disulfonated diphenyloxide (available from Dow Chemical Company as "Dowfax 2AO) dissolved in water. A comparison composition was prepared with 5 wt. % Oxone product dissolved in water. The inventive and comparison compositions were maintained at about 49° C. (120° F.) and aliquots periodically tested for the % of active oxygen remaining in solution. Table IV, below, illustrates the resultant data.

TABLE IV

| Elapsed Days | % a.o. Remaining, Comparison Composition | % a.o. Remaining, Inventive Composition |
|---|---|---|
| 5 | 85 | 85 |
| 10 | 30 | 72 |
| 15 | 15 | 60 |
| 20 | 5 | 55 |
| 25 | 2 | 50 |
| 30 | 1 | 40 |

As seen by the data of Table IV above, the inventive composition had about half of its original active oxygen remaining after 25 days and about 40% after 30 days when maintained at about 49° C. By contrast, the comparison composition, with the same initial amount of Oxone product in solution but without the necessary HLAS component, had substantially no active oxygen remaining under the same temperature conditions.

Compositions of the invention have advantageous physical properties in being physically stable, single-phase aqueous solutions and are useful for all-purpose, household cleaning, such as removing rust and mineral stains, as described by Example IV, below.

A Gardner Abrasion Tester was used for the soap scum, hard water deposit, oil/grease and soil removal tests, described below, to produce reproducible scrubbing in removing various stains from hard surfaces and to determine the relative cleaning performance of the tested compositions.

Performances of comparison and inventive compositions were evaluated by soaking and/or scrubbing using a Gardner Abrasion Tester and a damp sponge to which the compositions had been evenly applied. In the case of liquid compositions, about 15 ml were applied over the entire sponge surface. In the case of liquid abrasive compositions, about 3 grams were applied in a band across the middle of the sponge perpendicular to the long edge. In the case of powdered abrasive compositions, a slurry was first prepared of about 3 grams of product with about 1 gram synthetic hard water, and then 4 grams of the slurry applied as with the liquid abrasives.

EXAMPLE IV

Soap Scum Removal

The methodology for testing soap scum removal was as follows. Synthetic soap scum was sprayed onto black ceramic tile, baked in an oven and allowed to cool overnight prior to testing. The soap scums were prepared by means of a calcium stearate suspension comprising 85 wt. % ethanol, 5 wt. % calcium stearate, and 10 wt. % deionized water. The soap scum suspension was sprayed evenly onto ceramic tile surfaces, allowed to partially air dry, and then baked for one hour at 180°-185° C.

The Gardner Abrasion Tester was then set for 40 cycles per minute and the test tiles scrubbed for 125 strokes. Five graders then used a 1-10 scale, where a grade of "1" means no removal and a grade of "10"

means complete removal. Five replicates for each composition were run.

A commercially available liquid hard surface cleaner was utilized as a comparison composition (a). Comparison composition (a) was undiluted Lysol cleaner (available from Lehn & Fink Company). The inventive composition was 5 wt. % Oxone product, 1 wt. % HLAS, 0.5 wt. % Dowfax 2AO, and remainder water.

Comparison Composition (a): 3.48

Inventive Composition: 7.52

As can be seen from the soap scum scrub test data above, the inventive composition removed soap scum substantially better than did the commercially available, comparison liquid hard surface cleaner.

Hard Water Deposit Removal

The hard water stain removal test was wherein synthetically prepared hard water was sprayed onto hot ceramic tiles (180° C.) and then oven baked for an additional 45 minutes. The synthetically prepared hard water consisted of two premixed batches applied alternately to the tiles. One batch was 5 wt. % $Na_3SiO_3.5H_2O$ in 95 wt. % deionized water. The other was 73 wt. % deionized water, 24 wt. % ethanol, 2 wt. % calcium chloride (anhydrous) and 1 wt. % $MgCl_2.6H_2O$.

Another commercially available, comparison composition (b) was utilized in the hard water deposit removal tests. Comparison composition (b) was Tough Act cleaner, available from Dow Chemical Company. The inventive composition was as described for the soap scum removal. Three replicates of a 100-stroke scrub test were performed. The grading scale was 0 to 5 where "0" means no cleaning and "5" means total cleaning.

Comparison Composition (b): 0.83

Inventive Composition: 2.33

As can be seen by the above data, the inventive composition exhibited good hard water deposit removal performance, by contrast to the commercially available, hard surface cleaning comparison composition.

Oil/Grease Removal

Oil/grease soil (50° C.) was applied with a draw bar to white porcelain enameled steel plates and then allowed to age 5 days. The oil/grease soil preparation consisted of 60 g lard, 38 g vegetable oil and 2 g cobalt drier heated at about 120° C. for one hour with stirring.

The inventive composition was as previously described. A 0–10 point visual grade scale was used where "0" represents no oil/grease removal and "10" represents total removal.

Inventive Composition: 5.80

It is surprising that the inventive composition, in the absence of solvent, nevertheless provided good oil/grease removal.

Soil Removal

A commercially available, comparison composition (c) and the inventive composition as previously described were each tested with a performance scale of 0–100, where "0" represents no soil removal and "100" represents a totally clean surface. The commercially available comparison composition was Formula 409, available from The Clorox Company. Five replicates of each were run.

Comparison Composition (c): 66.78

Inventive Composition: 92.20

As may be seen by the above data, the first embodiment inventive composition provided excellent removal of particulate soils. In another set of tests utilizing the same comparison composition (c) and the inventive composition, but with Sanders and Lambert Urban Soil, the two different compositions both gave about equally good results.

The hard surface cleaners in accordance with the invention are phase-stable. For example, an inventive composition formed with 5 wt. % HLAS and 5 wt. %. Oxone product was prepared and stored at about 38° C. for 39 days. There was no syneresis. Similarly, inventive hard surface cleaning compositions were prepared as illustrated by Example V, below, and stored at either about 21° C. or about 38° C. and then inspected for phase stability.

EXAMPLE V

| Inventive Compositions | °C. | Storage (Days) | Syneresis |
|---|---|---|---|
| (a) 20 wt. % HLAS, 10 wt. % Oxone, rest water | 21 | 40 | None |
| (b) 20 wt. % HLAS, 10 wt. % Oxone, rest water | 38 | 33 | None |
| (c) 20 wt. % HLAS, 5 wt. % Oxone, rest water | 21 | 33 | None |
| (d) 20 wt. % HLAS, 5 wt. % Oxone, rest water | 38 | 39 | None |
| (e) 15 wt. % HLAS, 5 wt. % Oxone, rest water | 21 | 33 | None |
| (f) 15 wt. % HLAS, 5 wt. % Oxone, rest water | 38 | 39 | Slight |
| (g) 10 wt. % HLAS, 5 wt. % Oxone, rest water | 21 | 33 | None |
| (h) 10 wt. % HLAS, 5 wt. % Oxone, rest water | 38 | 33 | None |

In another test of phase stability, a variety of aqueous based solutions were prepared with different weight ratios of HLAS to Oxone product. Twenty-four hours after having been shaken, the compositions were then inspected for phase stability. Example VI, below, sets out the phase stable solutions in accordance with the present invention.

EXAMPLE VI

| % Wt., HLAS:Oxone Product | Appearance After 24 Hours Shaking |
|---|---|
| 1:1 | Clear, phase stable |
| 2:2 | White, phase stable |
| 3:3 | White, phase stable |
| 5:1 | Clear, light yellow, phase stable |
| 10:1 | Clear, yellow, phase stable |
| 10:7 | Light yellow, phase stable |
| 10:8 | Light yellow, phase stable |
| 15:7 | Light Yellow, phase stable |
| 15:10 | White, phase stable |
| 16:10 | White, phase stable |
| 17:10 | White, phase stable |
| 18:10 | White, phase stable |
| 19:10 | White, phase stable |
| 20:10 | White, phase stable |

The above solutions were then inspected 96 hours after having been shaken. The compositions were found to be still phase stable.

The second embodiment of the present invention further provides compositions which have non-Newtonian rheology but are flowable, and which are capable of stably suspending particles. Second embodiment compositions have at least about 5 wt. % to about 20 wt. % of the necessary linear alkyl aryl sulfonic acid component and at least about 2 wt. % to about 9 wt. % of the alkali metal peroxymonosulfate component (about 5 wt. % to about 20 wt. % Oxone product), both components being dissolved in water. These compositions preferably include a plurality of acid-stable abrasive particles in an amount up to about 50 wt. % with respect to the aqueous phase in which the two necessary components are dissolved, more preferably the abrasive particles are in an amount of from about 1 wt. % to about 30 wt. %, and most preferably are an amount of about 10 wt. %. The abrasive particles preferably have a size between about 1 to about 500 microns. Suitable materials for the abrasive particles include silica sand, amorphous silica, clay, zeolites, aluminum oxide, and the like.

As illustrated by Example VII, below, the capacity to stably suspend particles, such as acid-stable abrasives, is particularly surprising because neither of the necessary components alone has sufficient plastic, or non-Newtonian, rheology so as to provide the capacity to suspend abrasive particles (even when ionic strength of solutions in which one of the necessary components is dissolved is equivalent to that of second embodiment compositions).

EXAMPLE VII

Various concentrations of solutions having the Oxone product or HLAS were prepared and visually observed. Abrasive particles (silica sand) were then added as the compositions were again observed to determine whether the abrasive was suspended. Table V, below, illustrates the data.

TABLE V

| Compositions | Observations |
|---|---|
| (1) 9 parts of a 20 wt. % HLAS aqueous solution, 1 part silica sand | Two separate liquid phases. Top layer is yellow and thick, lower layer has some sand, but most sand is settled to bottom. |
| (2) 9 parts of a 10 wt. % HLAS aqueous solution, 1 part sand | One liquid phase, but the sand is settled at bottom. |
| (3) 9 parts of a 5 wt. % HLAS aqueous solution, 1 part sand | One liquid phase, but the sand is settled at bottom. |
| (4) 9 parts of a 20 wt. % Oxone aqueous solution, 1 part sand | One liquid phase, but the sand is settled at bottom. |
| (5) 9 parts of a 10 wt. % Oxone aqueous solution, 1 part sand | One liquid phase, but the sand is settled at bottom. |
| (6) 9 parts of a 5 wt. % Oxone aqueous solution, 1 part sand | One liquid phase, but the sand is settled at bottom. |

The capacity of a composition to suspend particulates can be inferred from analyzing compositions with a HAAKE viscometer. Compositions which display Newtonian behavior typically will not suspend abrasives, whereas compositions which display non-Newtonian behavior can be predicted to have the capacity to suspend abrasives.

Thus, Example VIII and Table VI, below, illustrate Newtonian behavior for a comparison composition, whereas Examples IX–X and Tables VII–VIII illustrate the non-Newtonian behavior of second embodiment compositions.

EXAMPLE VIII

An aqueous solution with 20 wt. % HLAS was prepared and tested at a temperature of 25° C. with a HAAKE viscometer. Data was taken during rotor speed increase and then during decrease, as illustrated in Table VI, below.

TABLE VI

| rotor RPM | sheer stress (dynes/cm$^2$) | viscosity (cp) |
|---|---|---|
| 20 | 7.5 | 146.6 |
| 40 | 14.0 | 136.9 |
| 60 | 21.0 | 136.9 |
| 80 | 27.5 | 134.4 |
| 100 | 34.5 | 134.9 |
| 80 | 27.5 | 134.4 |
| 60 | 22.0 | 143.4 |
| 40 | 14.0 | 136.9 |
| 20 | 7.5 | 146.6 |

As can be seen by the data of Table VI, above, the composition with only the HLAS component displayed a substantially constant viscosity in response to increase or decrease in rotor speeds. (That is, the composition displayed Newtonian behavior). As previously illustrated by composition (1) of Table V, a 20 wt. % HLAS solution does not stably suspend abrasives.

EXAMPLE IX

An inventive composition, capable of stably suspending particles, was prepared having 20 wt. % HLAS and 7.5 wt. % Oxone product. When this liquid composition was analyzed with a HAAKE viscometer in an analogous manner as described in Example VIII, the following data was obtained as shown in Table VII, below.

TABLE VII

| rotor RPM | sheer stress (dynes/cm$^2$) | viscosity (cp) |
|---|---|---|
| 20 | 72 | 1398 |
| 40 | 81 | 786 |
| 60 | 87 | 563 |
| 80 | 94 | 456 |
| 100 | 98 | 380 |
| 80 | 94 | 456 |
| 60 | 87 | 563 |
| 40 | 81 | 786 |
| 20 | 72 | 1398 |

As may be seen by the data of Table VII, above, the inventive composition displays non-Newtonian behavior.

EXAMPLE X

An inventive composition was prepared as described by Example IX, except that 10 wt. % of silica sand was also incorporated. The resultant composition was a milky white, phase-stable liquid composition which was very viscous and in which the silica sand was stably suspended. This inventive composition was analyzed with a HAAKE viscometer. The non-Newtonian behavior of the inventive composition is illustrated by the data of Table VIII, below.

TABLE VIII

| rotor RPM | sheer stress (dynes/cm$^2$) | viscosity (cp) |
|---|---|---|
| 20 | 60 | 3456 |

TABLE VIII-continued

| rotor RPM | sheer stress (dynes/cm$^2$) | viscosity (cp) |
|---|---|---|
| 40 | 66 | 1901 |
| 60 | 72 | 1382 |
| 80 | 77 | 1109 |
| 100 | 81 | 933 |
| 80 | 77 | 1109 |
| 60 | 73 | 1402 |
| 40 | 68 | 1958 |
| 20 | 62 | 3571 |

EXAMPLE XI

Four compositions in accordance with the second embodiment were prepared with varying amounts of HLAS (10 wt. %, 15 wt. % and 20 wt. %) and varying amounts of the Oxone product (5 wt. % and 10 wt. %). Then 10 wt. % of abrasive particles (silica sand) were admixed into these compositions. The compositions were left to stand overnight and then examined. All these compositions maintained the abrasive in suspension and maintained phase stability.

Two of the inventive compositions in accordance with the second embodiment were then tested alongside a commercially available hard surface cleaner in a hard water deposit removal test (using 50 strokes and the methodology for hard water deposit removal testing as previously described). The commercially available comparison composition (d) was Comet powder (available from Proctor & Gamble). The grading scale was 0 to 5 where "0" means no cleaning and "5" means total cleaning. The results are set out in Table IX, below.

TABLE IX

| Composition Tested | Hard Water Removal |
|---|---|
| Comparison Composition (d) | 2 |
| Inventive Composition (20 wt. % HLAS, 10 wt. % Oxone, 10 wt. % abrasive, rest water) | 5 |
| Inventive Composition (10 wt. % HLAS, 5 wt. % Oxone, 10 wt. % abrasive, rest water) | 5 |

As can be seen by the above data, the inventive compositions provided excellent cleaning of the hard water deposits.

The inventive compositions may be prepared with various orders of adding the necessary, preferred and any optional components. Typically, the linear alkyl aryl sulfonic acid component will be diluted by dissolving in water and the alkali metal peroxymonosulfate component then added.

The abrasive particles of the second embodiment may be incorporated and stably dispersed by simple admixing. Optional components in compositions of the invention include acid stable dyes, fragrances and defoamers.

While the invention has been described in connection with specific embodiments thereof, it will be understood that it is capable of further modification, and this application is intended to cover any variations, uses or adaptations of the invention following, in general, the principles of the invention and including such departures from the disclosure as come within the known or customary practice in the art to which the invention pertains and as may be applied to the essential features hereinbefore set forth, and as fall within the scope of the invention and the limits of the appended claims.

We claim:

1. A liquid hard surface cleaner comprising:

a single-phase, substantially phase stable aqueous solution, said aqueous solution having linear alkyl aryl sulfonic acid and potassium peroxymonosulfate dissolved therein, said potassium peroxymonosulfate having a determinable chemical stability, said linear alkyl aryl sulfonic acid in an amount not greater than about 10 wt. % and with a weight ratio with respect to said potassium peroxymonosulfate of from about 1:0.05 to about 0.05:1, the aqueous solution having a pH of about 1 to about 1.5, said amount of linear alkyl aryl sulfonic acid being effective to increase the chemical stability of said potassium peroxymonosulfate with respect to the determinable chemical stability thereof.

2. The liquid hard surface cleaner as in claim 1 wherein said amount of linear alkyl aryl sulfonic acid is effective in increasing the chemical stability of said potassium peroxymonosulfate with respect to the determinable chemical stability thereof.

3. The liquid surface cleaner as in claim 1 wherein said linear alkyl aryl sulfonic acid is in an amount of from about 2 to about 5 wt. %.

* * * * *

UNITED STATES PATENT AND TRADEMARK OFFICE

CERTIFICATE OF CORRECTION

PATENT NO. : 4,804,491

DATED : February 14, 1989

INVENTOR(S) : Clement Kin-Man Choy et al

It is certified that error appears in the above-identified patent and that said Letters Patent is hereby corrected as shown below:

Column 12, lines 41 to 45, delete claim 2.

Column 12, line 46, "3. The liquid surface" should read -- 2. The liquid hard surface --.

Column 12, after line 48, insert -- 3. The liquid hard surface cleaner as in claim 2 wherein said potassium peroxymonosulfate is in a amount of from about 2 to about 9 wt. %. --.

Signed and Sealed this

Twenty-sixth Day of September, 1989

*Attest:*

*Attesting Officer*

DONALD J. QUIGG

*Commissioner of Patents and Trademarks*